United States Patent [19]

Baumert

[11] 4,175,612

[45] Nov. 27, 1979

[54] APPARATUS FOR MEASURING AND CONTROLLING THE LEVEL OF MOLTEN STEEL IN A CONTINUOUS-CASTING MOLD

[75] Inventor: Jean Baumert, Esch, Luxembourg

[73] Assignee: ARBED Acieries Reunies de Burbach-Eich-Dudelange S.A., Luxembourg, Luxembourg

[21] Appl. No.: 851,635

[22] Filed: Nov. 15, 1977

[51] Int. Cl.[2] ..... B22D 11/16; B22D 1/02

[52] U.S. Cl. ..... 164/449; 164/4

[58] Field of Search ..... 164/4, 449, 155; 73/290 R; 331/65; 324/236, 204, 208; 340/244 R, 246

[56] References Cited

U.S. PATENT DOCUMENTS

| | | | |
|---|---|---|---|
| 2,671,275 | 3/1954 | Burns, Jr. | 324/247 |
| 3,152,303 | 10/1964 | Lary et al. | 324/204 |
| 3,217,204 | 11/1965 | Nance | 324/236 X |
| 3,519,060 | 7/1970 | Vischulis | 164/449 |
| 3,838,727 | 10/1974 | Levi et al. | 164/4 |
| 3,997,835 | 12/1976 | Ando et al. | 324/207 |
| 4,027,233 | 5/1977 | Shmakov et al. | 324/204 |
| 4,030,027 | 6/1977 | Yamada et al. | 324/207 |

FOREIGN PATENT DOCUMENTS

| | | | |
|---|---|---|---|
| 834783 | 5/1960 | United Kingdom | 164/449 |

*Primary Examiner*—Robert D. Baldwin
*Assistant Examiner*—K. Y. Lin
*Attorney, Agent, or Firm*—Karl F. Ross

[57] ABSTRACT

An apparatus for controlling the level of liquid steel in a continuous-casting mold wherein the position of the molten steel level within the mold is detected by a coil juxtaposed therewith and forming part of a resonant circuit controlling an oscillator. The capacitor portion of this resonant circuit is formed at least in part by a coaxial cable connecting the coil to the balance of the oscillator circuit. The output frequency of the oscillator is combined with the signal of a reference oscillator in a modulator, the low-frequency passband of this signal is then transformed into an analog voltage proportional to frequency and is used to control a servomotor which regulates the feed of molten metal to the mold.

5 Claims, 3 Drawing Figures

APPARATUS FOR MEASURING AND CONTROLLING THE LEVEL OF MOLTEN STEEL IN A CONTINUOUS-CASTING MOLD

FIELD OF THE INVENTION

The present invention relates to an apparatus for measuring and controlling the liquid steel level in a continuous-casting mold and, more particularly, to a level-sensing device and control circuit for a continuous-casting process.

BACKGROUND OF THE INVENTION

In the continuous casting of steel, the molten metal is introduced into an upright ingot mold, usually by a tundish, and progressively solidifies within this mold. From the bottom of the mold, a continuous ingot emerges which can be cut into lengths for subsequent rolling.

The operation of a continuous-casting mold is a function of the level of the liquid melt maintained therein. Hence it is necessary to provide means for regulating this level.

In addition, the ingot mold is usually vibrated or oscillated to facilitate passage of the molten and solidifying metal therethrough. Hence, the detection of the continuously mobile surface of the melt within the mold poses problems.

OBJECTS OF THE INVENTION

The principal object of the present invention is to provide an apparatus for measuring and controlling the level of liquid steel in a continuous-casting mold.

Another object of this invention is to provide an apparatus for measuring and controlling the level of liquid steel within a continuous-casting mold whereby disadvantages of earlier control systems are obviated.

SUMMARY OF THE INVENTION

According to the invention, the measurement and control of the level of liquid steel in an ingot mold is effected by bringing about a variation of the frequency of an electric oscillating circuit as a function of the distance between the level of steel in the mold and a coil constituting one of the active elements of an oscillating circuit.

The invention makes use of the fact that an oscillator using a capacitive or inductive element to determine the frequency of the oscillator, generally in a resonant network, will bring about a change in the oscillator frequency as a result of the approach of a body of ferrous metal toward or a recession of this body of ferrous metal from a coil juxtaposed therewith.

The detector of the apparatus according to the present invention comprises an electric coil constituted of a tube of a conductive material encased in or supported by a refractory material, the coil having one or more turns.

A variation of the level of the molten-metal bath juxtaposed with this coil, which preferably lies in a plane generally parallel to the surface of the bath and hence horizontally, results in a variation of the output frequency of an oscillator circuit because of changes in the electrical characteristics, such as the inductance or capacitance of the coil thus constituted when the coil forms part of a resonant network controlling the frequency of the oscillator.

The fixed capacitance of the oscillator circuit of the present invention is principally constituted by a system of two coaxial elements such as a flexible coaxial cable or two concentric rigid tubes.

To minimize the external parasitic influences upon the frequency, such as those which are due to a vertical oscillating movement of the ingot mold and those which result from displacement of the jet of steel entering the ingot mold from the tundish, the coil is enclosed in a static annular crown open at its lower face turned toward the free surface of the steel bath. This static crown can be constituted of soft iron and can be connected to the zero-voltage or grounded conductor of the coaxial capacitor.

According to the invention, the coil is disposed horizontally and concentrically with respect to the ingot mold, i.e. so that its axis coincides with that of the ingot mold. The coil is disposed within the interior of the ingot mold at a predetermined distance from the surface of the bath (mean), for example about 10 cm from the latter.

The coaxial system serves on the one hand as the conductor connecting the sensing coil to the oscillator and, on the other hand, as all or part of the capacitance of the resonant network. The external conductor of the coaxial conductor, which is at zero reference potential, can be connected to the static crown surrounding the measuring coil.

To compensate for a frequency shift of the resonant network because of deformation of the coil under the effect of heat, the coil can be traversed by a stream of collant, e.g. water, and, in addition, a thermocouple can be incorporated in the housing for the coil. The output signal of the thermocouple is used to provide temperature compensation of the oscillating circuit, for example, through an operational amplifier and a controlled diode.

As the free surface of the molten steel is a surface in movement, the frequency of the oscillator varies about a mean value corresponding to a given mean level of the liquid. In order to stabilize the signal utilized for control of the supply of steel to the ingot mold, the circuit to which the oscillator is connected comprises a circuit capable of forming a mean value.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
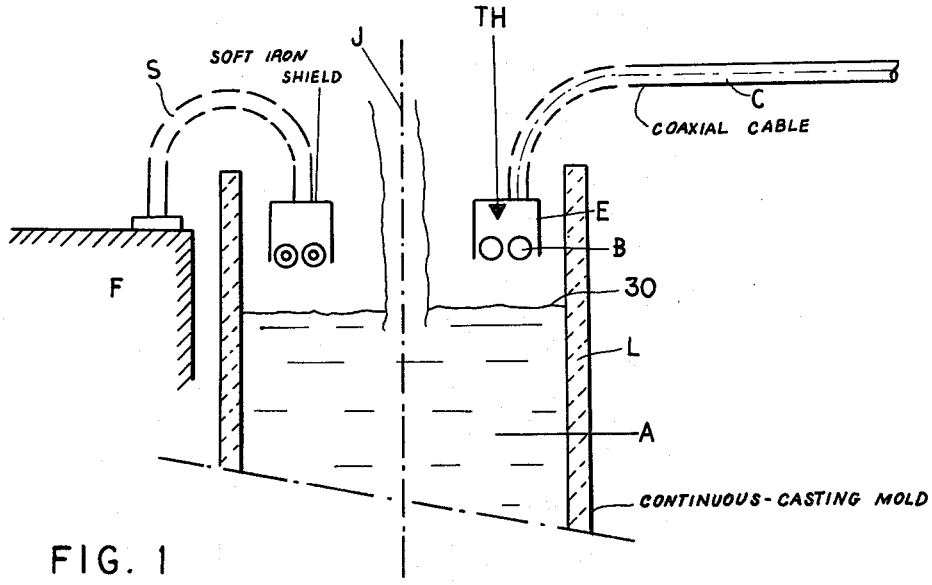
FIG. 1 is a diagrammatic-vertical section of the detector portion of an apparatus in accordance with the present invention.

Referring first to FIG. 1, it will be apparent that the basic elements of the detector portion of the apparatus of the present invention comprises a support or foundation F with respect to which an ingot mold L for the continuous casting of steel can be oscillated. The level of the liquid is represented at 30 in the mold which contains a body of molten steel A supplied thereto by a tundish at a rate which can be controlled by a servomotor.

Disposed within the ingot mold and in a horizontal plane, is a measuring coil B which is enclosed in a downwardly open cylindrical housing E which can be composed of soft iron. The housing E is annular and surrounds the jet J of steel entering the ingot mold from the tundish.

The housing E on which the coil B is supported by means not shown, is mounted upon the foundation F by a support shown as an arm S in FIG. 1. The coil B is connected by a coaxial cable C which simultaneously serves as a capacitor in parallel with the coil B and forming a resonant network therewith.

A thermocouple TH disposed within the housing E can be provided to afford temperature compensation of the oscillator for which the coaxial cable C and the coil B constitute the frequency-controlling resonant network.

Thus the assembly of the coil B and the housing E are mounted at a fixed location via the supports S while the central wire of the coaxial cable C is connected to one end of the coil B, the other end being affixed to the housing E to which the shield or outer element of the coaxial cable is also connected. The housing E and the shield of the coaxial cable are at reference voltage level O.

In a preferred embodiment of the invention, the coil B is constituted by four turns of a diameter of 100 mm, the conductor C being a coaxial cable having a length of 3.8 m and a capacity of 240 pF. This gives a frequency $f_u$ at resonance of substantially 4.6 MHz.

With this circuit, and a variation of the level of the bath of 10 mm toward the coil, there is a nonlinear frequency shift of about 20–40 kHz.

Figure 3:
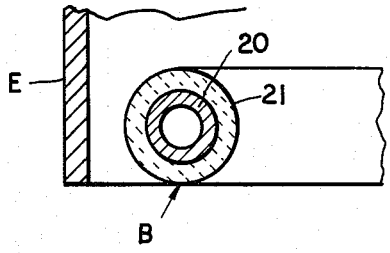
FIG. 3 is a detail view, in cross-section, showing the construction of a portion of the coil of the present invention.

In FIG. 3 there is shown a coil B which is constituted by turns of a metal tube 20 which can be traversed by cooling water and which is surrounded in a sheath 21 of refractory material, e.g. alumina.

Figure 2:
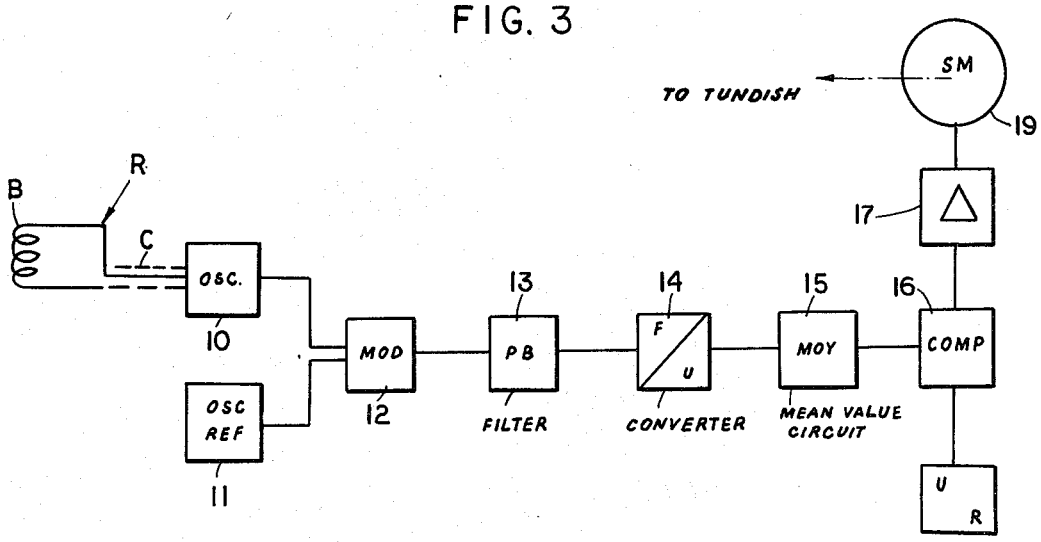
FIG. 2 is a circuit diagram, in block form, of the control circuit of the present invention.

The circuit for the apparatus of FIG. 1 has been illustrated in FIG. 2.

If it is supposed that the resonance frequency of the detector, which is arbitrarily selected, is relatively high, it is possible to obtain a variation in frequency of the signal $f_u$ within the acoustic frequency range. While this is not essential, it has been found to be desirable.

The resonance network R formed by the coil B and the coaxial cable C control the frequency of an oscillator 10. The output of this oscillator is fed to a modulator 12 which is also supplied with the output frequency of a reference oscillator 11.

The modulator 12 forms the sum and the difference of the frequency $f_u$ generated by the oscillator 10 and $f_r$ produced by the reference oscillator 11.

The modulator output is applied through a low-pass filter 13 which eliminates the sum $f_r+f_u$.

The analog-control circuitry is constituted by a frequency/voltage converter 14 which receives the signal $f_r-f_u$ from the low-pass filter 13 and produces a voltage proportional to the frequency of its input signal. Note, however, that $f_u$ and, consequently, $f_r-f_u$, are not linear functions of the distance between the coil and the level of the molten-steel bath within the ingot mold. Linearity is not a condition for proper functioning of the system.

The circuitry is dimensioned such that the minimum value of $f_r-f_u$, or the maximum value, represents a minimum level of the molten steel in the ingot mold and inversely. Thus, a mean value of the voltage generated by the converter which is able to have its output vary in both senses, corresponds to the mean level of the molten steel within the ingot mold.

The frequency $f_u$ which is an image of the free surface of the liquid steel thus oscillates about a mean value corresponding to a given mean level. In the interest of stability, the parasitic variations are excluded with the aid of a circuit capable of forming a mean, represented at 15 and constituted by a low-pass filter or a window circuit of low level. The comparator 16, which receives the output from the mean-value circuit 15, also receives a reference signal from a set-point generator 4R.

The difference signal is applied via an amplifier 17 to a servomotor 19 which controls the rate at which the steel is supplied to the ingot mold from the tundish or the rate at which steel is applied to the tundish if the tundish delivers steel at the rate it is supplied therewith.

The continuous-casting mold can be of the type described at pages 709 ff. of THE MAKING, SHAPING AND TREATING OF STEEL, U.S.Steel Co., Pittsburgh, Pa., 1971 and includes the oscillator described there and in the associated section of this work. The oscillator 10 can be of the type described at section 5, pages 5 ff. of the HANDBOOK OF SELECTED SEMICONDUCTOR CIRCUITS, U.S. Government Printing Office, 1960, i.e. a Hartley or Colpitts oscillator in which the frequency-controlling inductance of the tuned circuit is constituted by the coil B.

The modulator 12 can be of the type described at pages 738 ff. of PULSE, DIGITAL AND SWITCHING WAVEFORMS, McGraw-Hill Book Co., 1965 (see also section 10 pages 9 ff. of HANDBOOK OF SELECTED SEMICONDUCTOR CIRCUITS) and the bandpass filter 13 can be of the type described therein as well.

The frequency/voltage converter can be of the type described at pages 674 ff. of PULSE, DIGITAL AND SWITCHING WAVEFORMS(see also see section 10, pages 2 ff. of the HANDBOOK OF SELECTED SEMICONDUCTOR CIRCUITS). The mean value circuit 15 can be a low-pass filter of the type described in OPERATIONAL AMPLIFIER, DESIGN AND APPLICATION, McGraw-Hill Co., 1971 and the comparator 16 with its setpoint value generator 18 can be of the type described at pages 358 through 366 thereof. The servomotor and its amplifier may be of the type described at pages 276 through 314 of SERVOMECHANISM PRACTICE, McGraw-Hill Book Co., 1960.

I claim:

1. The combination with a continuous-casting mold of an apparatus for controlling the level of liquid steel is said continuous-casting mold, said apparatus comprising:

an oscillator having a resonant network including a coil in said mold surrounding a stream of steel flowing into the mold, and a capacitor, said ascillator generating a frequency constituting a function of the location of the steel-melt surface within said mold;

circuit means connected to said oscillator for controlling the rate of feed of molten steel to said mold, said coil having a plurality of rigid turns supported and surrounded by a refractory material and disposed in the interior of said mold concentrically therewith in a horizontal plane;

an annular downwardly open static metallic crown receiving said coil and said refractory material and disposed in said mold above said surface, said crown is connected to a coaxial conductor forming intrinsically part of said capacitor and having a conductive member connected to said crown; and means for supporting said coil within said mold from a location outside the latter and independently of movement of said mold.

2. The combination defined in claim 1 wherein said circuit means includes a filter.

3. The combination defined in claim 1 further comprising a thermocouple disposed proximal to said coil for measuring the temperature thereof and providing temperature compensation for said oscillator.

4. The combination defined in claim 1 wherein said coaxial conductor is a coaxial cable.

5. The combination defined in claim 7 wherein said circuit means includes;

a modulator connected to said oscillator, a reference oscillator connected to said modulator whereby said modulator forms the sum of the frequencies of said oscillators and the difference of said frequencies, said filter being connected to said modulator to pass only the difference of said frequencies, a frequency/voltage converter connected to said filter for producing a voltage output which is a function of said difference of said frequencies, a mean-value circuit connected to said converter for producing an output representing the mean value of said voltage, a comparator connected to said mean-value circuit and receiving said output thereof, a setpoint value generator connected to said comparator for providing a setpoint value representing the desired level of molten steel in said mold, and a servomotor connected to said comparator for controlling the rate of flow of molten steel to said mold upon deviation of the output of said mean-value circuit from a setpoint value.

* * * * *